US009705291B2

(12) United States Patent
Yamada et al.

(10) Patent No.: US 9,705,291 B2
(45) Date of Patent: Jul. 11, 2017

(54) IGNITION PLUG

(71) Applicant: NGK SPARK PLUG CO., LTD., Nagoya-shi, Aichi (JP)

(72) Inventors: Yuichi Yamada, Aichi (JP); Takuya Kawade, Hashima (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/072,820

(22) Filed: Mar. 17, 2016

(65) Prior Publication Data

US 2016/0294163 A1 Oct. 6, 2016

(30) Foreign Application Priority Data

Apr. 2, 2015 (JP) ..... 2015-075602

(51) Int. Cl.

| | |
|---|---|
| ***F02B 19/12*** | (2006.01) |
| ***H01T 13/32*** | (2006.01) |
| ***H01T 13/16*** | (2006.01) |
| ***H01T 13/39*** | (2006.01) |

(52) U.S. Cl.

CPC ..... *H01T 13/32* (2013.01); *H01T 13/16* (2013.01); *H01T 13/39* (2013.01)

(58) Field of Classification Search

None

See application file for complete search history.

(56) References Cited

U.S. PATENT DOCUMENTS

| | | | | |
|---|---|---|---|---|
| 4,881,913 | A | 11/1989 | Mann | 445/7 |
| 2001/0025617 | A1* | 10/2001 | Kanao | H01T 21/02 123/169 EL |
| 2002/0130602 | A1* | 9/2002 | Kanao | H01T 21/02 313/141 |
| 2003/0038575 | A1* | 2/2003 | Hori | H01T 13/39 313/141 |
| 2004/0041505 | A1* | 3/2004 | Fischer | H01T 13/32 313/141 |
| 2007/0216275 | A1 | 9/2007 | Torii et al. | 313/141 |

FOREIGN PATENT DOCUMENTS

| | | | | |
|---|---|---|---|---|
| GB | 2039605 | A | 8/1980 | H01T 13/16 |
| JP | H05-13146 | A | 1/1993 | H01T 13/20 |
| JP | H05-114457 | A | 5/1993 | H01T 13/20 |
| JP | 2004-152682 | A | 5/2004 | C22C 5/04 |

OTHER PUBLICATIONS

Extended European Search Report issued in corresponding European Patent Application No. 16161495.3, dated Aug. 31, 2016.

Office Action issued in corresponding Japanese Patent Application No. 2015-075602, dated Feb. 7, 2017 (English translation provided).

* cited by examiner

*Primary Examiner* — Tracie Y Green

(74) *Attorney, Agent, or Firm* — Kusner & Jaffe

(57) ABSTRACT

An ignition plug having a ground electrode that includes a base material layer and an erosion-resistant layer having a thermal conductivity of 40 w/m·K or more. The erosion-resistant layer extends at least from the center-electrode-facing portion to a location closer to the fixed end than a front end of the center electrode and 0.2 mm≤thickness t1 of the erosion-resistant layer≤thickness T of the ground electrode 30–0.6 mm is satisfied.

7 Claims, 4 Drawing Sheets

IGNITION PLUG

RELATED APPLICATIONS

This application claims the benefit of Japanese Patent Application No. 2015-075602, filed Apr. 2, 2015, the entire contents of which are incorporated herein by reference.

FIELD OF THE INVENTION

The present invention relates to an ignition plug used to ignite an air-fuel mixture in an internal combustion engine.

BACKGROUND OF THE INVENTION

An electrode material with which thermal resistance, corrosion resistance, and thermal conductivity can be increased without using a noble metal or a noble metal alloy has been proposed as an electrode material for a center electrode and a ground electrode of an ignition plug (see, for example, Japanese Unexamined Patent Application Publication No. 5-114457).

In recent years, to increase the fuel efficiency of a vehicle and meet emissions regulations that have become more and more severe every year, an air-fuel ratio in the lean range, in which the air-fuel ratio is lower than the stoichiometric air-fuel ratio, has been commonly used as the air-fuel ratio while the vehicle is moving. To increase the fuel efficiency of a vehicle and meet emissions regulations, the air-fuel mixture is desirably completely combusted irrespective of the air-fuel ratio. Therefore, it is desirable to increase the ignitability of an air-fuel mixture having an air-fuel ratio lower than the stoichiometric air-fuel ratio. To achieve this, for example, a current (energy) applied to the ignition plug has been increased to increase the size of the spark generated at the time of ignition, a time period for which electricity is supplied to the ignition plug has been increased, and the fuel has been directly injected into a combustion chamber.

The increase in the size of the spark and the time period for which electricity is supplied tend to cause sway of the spark. When the direct injection technology is used, fuel injection may be performed a plurality of times within a single cycle, and the air-fuel mixture may flow at a high speed or in a complex manner in the combustion chamber depending on the ignition timing. In this case, the frequency of a ground electrode being affected by sway of the spark increases, and the degree of erosion of the base material of the ground electrode increases accordingly. As a result, there is a risk of misfiring due to separation of a noble metal chip bonded to the ground electrode or breakage of the ground electrode. In particular, erosion of a base portion of the ground electrode leads to a breakage of the ground electrode, resulting in a reduction in the performance of the ignition plug. When the ground electrode is protected simply by being coated with a noble metal or the like, the cost thereof is increased. The related art does not sufficiently address these problems.

There is still room for improvement in terms of the structure of the ground electrode with which uneven wear of the base material of the ground electrode can be effectively prevented or reduced. In particular, it is desirable to reduce uneven wear of the base material of the ground electrode without using a noble metal or a noble metal alloy. Furthermore, in the ground electrode structure including a noble metal chip, the structure for preventing or reducing uneven wear of the base material of the ground electrode and satisfactory bondability between the ground electrode and the noble metal chip have not been sufficiently studied.

Accordingly, there is a demand for an ignition plug in which erosion and uneven wear of a ground electrode can be prevented or reduced without using a noble metal or a noble metal alloy. There is also a demand for an ignition plug in which the occurrence of separation between the ground electrode and a noble metal chip can be prevented or reduced.

The present invention has been made to solve at least one of the above-described problems. Aspects of the present invention will now be described.

SUMMARY OF THE INVENTION

A first aspect provides an ignition plug. The ignition plug of the first aspect includes an insulator having an axial hole; a metal shell that covers an outer periphery of the insulator; a center electrode disposed in the axial hole of the insulator and having a front end exposed at a front end of the insulator; and a ground electrode having a fixed end fixed to the metal shell, a free end including a center-electrode-facing portion that faces a front end surface of the center electrode, and an inner surface that faces the center electrode and the insulator. The ground electrode includes a first layer and a second layer having a composition different from a composition of the first layer and stacked on an inner surface of the first layer, the second layer having a thermal conductivity of 40 w/m·K or more and extending at least from the center-electrode-facing portion to a location closer to the fixed end than the front end of the center electrode in cross section extending through a central line of the ground electrode in a width direction. When a thickness of the ground electrode is T (mm) and a thickness of the second layer is t1 (mm), $0.2\ \text{mm} \leq t1 \leq T-0.6\ \text{mm}$ is satisfied.

According to the ignition plug of the first aspect, erosion and uneven wear of the ground electrode can be prevented or reduced without using a noble metal or a noble metal alloy, and the occurrence of separation between the ground electrode and a noble metal chip can be prevented or reduced.

In the ignition plug according to the first aspect, the center-electrode-facing portion may have a projection that projects beyond the second layer. In this case, erosion of the ground electrode can be more reliably prevented or reduced.

In the ignition plug according to the first aspect, the projection may be bonded to the first layer. In this case, it is possible to prevent or suppress a reduction in the bonding strength between the ground electrode and the projection, and the occurrence of separation of the projection from the ground electrode can be prevented or reduced.

In the ignition plug according to the first aspect, the projection contains a noble metal as a main component. In this case, erosion of the projection can be reduced.

In the ignition plug according to the first aspect, the second layer may be arranged so as to extend over an entire region of the inner surface of the ground electrode, and the thickness t1 of the second layer may be 0.2 mm or less in a region from a second center-electrode-facing portion that faces a front-end peripheral portion of the center electrode at a fixed-end side to the fixed end. In this case, it is possible to prevent or suppress a reduction in the bonding strength between the ground electrode and the metal shell, and the occurrence of an abnormality in the bonding region between the metal shell and the ground electrode can be prevented or reduced.

In the ignition plug according to the first aspect, the second layer may be made of a nickel (Ni) alloy or an iron (Fe) alloy that differs from a material of the first layer. In this case, erosion and uneven wear of the ground electrode can be prevented or reduced without using a noble metal or a noble metal alloy, and the occurrence of separation between the ground electrode and a noble metal chip can be prevented or reduced.

The present invention may also be embodied as an ignition-plug control apparatus in which an ignition plug and a long spark coil are combined, and a spark control method for the ignition plug control apparatus.

DETAILED DESCRIPTION OF THE PREFERRED EMBODIMENTS

Figure 1:
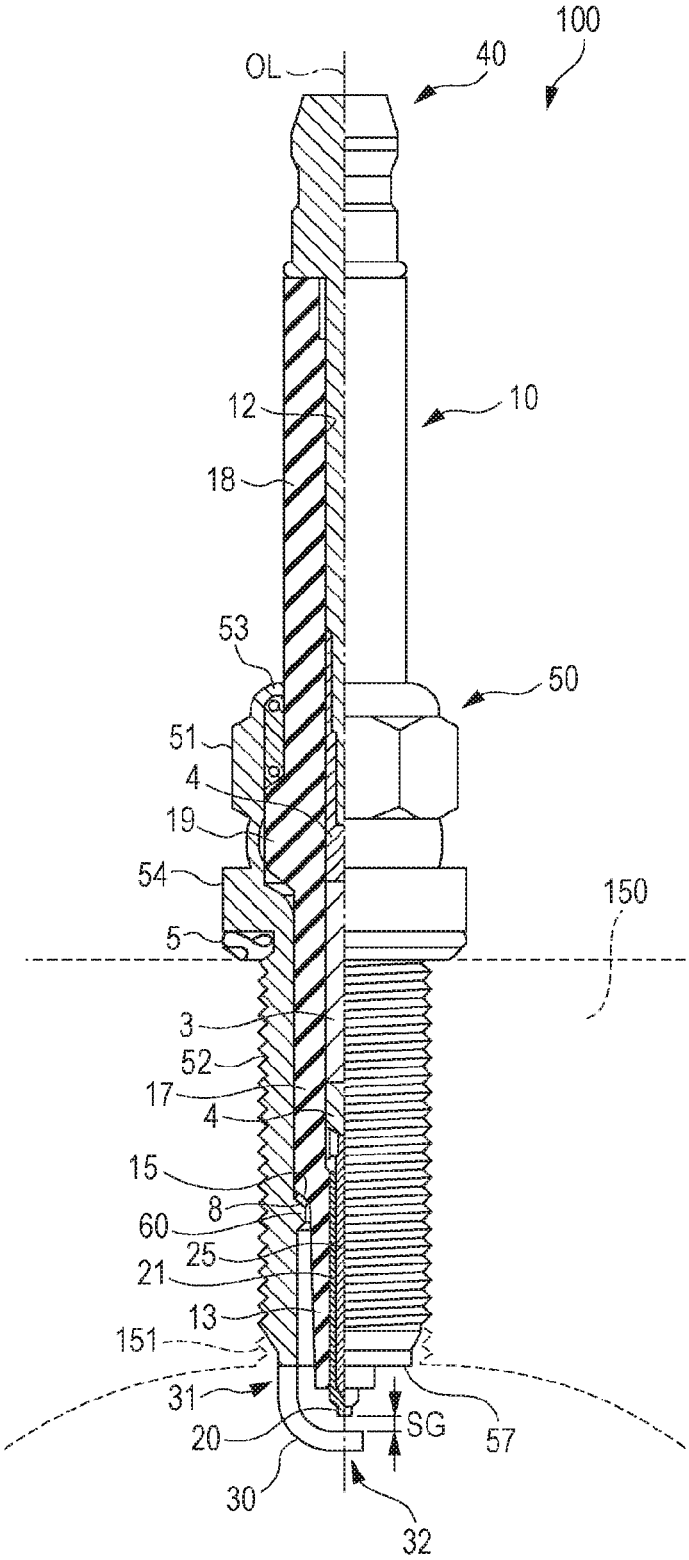
FIG. 1 is a partially sectioned view of a spark plug according to an embodiment.

A spark plug 100, which is an example of an ignition plug according to the present invention, will be described with reference to the drawings. FIG. 1 is a partially sectioned view of the spark plug 100 according to the present embodiment. In FIG. 1, an axial line OL shown by the one-dot chain line is the central axis of the spark plug 100 in the longitudinal direction. The right side of the axial line OL shows an external front view, and the left side of the axial line OL shows a sectional view of the spark plug 100 taken along a plane that passes through the central axis of the spark plug 100. Referring to FIG. 1, in the following description, the lower side in the direction of the axial line OL of the spark plug 100, that is, the side at which the spark plug 100 is exposed in a combustion chamber, is referred to as a front side of the spark plug 100, and the upper side in the direction of the axial line OL of the spark plug 100, that is, the side at which an ignition cable is attached to the spark plug 100, is referred to as a rear end. The spark plug 100 includes an insulator 10, a center electrode 20, a ground electrode 30, a terminal electrode 40, and a metal shell 50.

The insulator 10 is a cylindrical insulator formed by baking a ceramic material, such as alumina. The insulator 10 has an axial hole 12, which receives the center electrode 20 and the terminal electrode 40 and extends in the direction of the axial line OL, at the center thereof. The insulator 10 includes a central body portion 19, which has the maximum outer diameter, in a central region thereof in the direction of the axial line OL. The insulator 10 also includes a rear-side body portion 18, which insulates the terminal electrode 40 from the metal shell 50, on the rear side of the central body portion 19. The insulator 10 also includes a front-side body portion 17, which has an outer diameter smaller than that of the rear-side body portion 18, on the front side of the central body portion 19. The insulator 10 also includes a leg portion 13, which has an outer diameter that is smaller than that of the front-side body portion 17 and decreases toward the center electrode 20, on the front side of the front-side body portion 17. A diameter-reducing portion 15, which connects the front-side body portion 17 and the leg portion 13 and has an outer diameter that decreases toward the front side, is formed between the front-side body portion 17 and the leg portion 13.

The center electrode 20 is inserted in the axial hole 12. The center electrode 20 is a rod-shaped member including an electrode base material 21 having a cylindrical shape with a bottom and a core material 25 that is embedded in the electrode base material 21 and has a thermal conductivity higher than that of the electrode base material 21. In the present embodiment, the electrode base material 21 is made of a nickel alloy containing nickel (Ni) as the main component. The core material 25 is made of copper or an alloy containing copper as the main component. The center electrode 20 is held by the insulator 10 in the axial hole 12 such that the front end thereof projects from the axial hole 12 (insulator 10) and is externally exposed. The center electrode 20 is electrically connected to the terminal electrode 40 with a ceramic resistor 3 and a sealing member 4, which are inserted in the axial hole 12, interposed therebetween.

The ground electrode 30 is formed of two layers, which are a base material layer 301 and an erosion-resistant layer 302. The base material layer 301, which serves as a first layer, has an inner surface 30*a* facing the center electrode 20 and the insulator 10. The erosion-resistant layer 302, which serves as a second layer, serves to prevent or reduce erosion of the base material. The base material layer 301 is made of a highly corrosion-resistant metal, such as a nickel alloy. The erosion-resistant layer 302 is made of a nickel alloy having a composition different from that of the base material layer 301, and is arranged on the inner surface of the base material layer 301, that is, on the inner surface 30*a* of the ground electrode 30. The materials of the ground electrode may further include an iron alloy or a stainless steel. Examples of compositions of the base material layer 301 and the erosion-resistant layer 302 will be given below in the description of studies. A fixed end (proximal end) 31 of the ground electrode 30 is welded to a front end surface 57 of the metal shell 50. In this specification, the fixed end 31 is defined so as to include a melted portion (melted material) that squeezes out when the ground electrode 30 is fusion-bonded to the metal shell 50. The ground electrode 30 that extends from the fixed end 31 is bent toward the center electrode 20 so that a free end (distal end) 32 of the ground electrode 30 is spaced from the front end surface of the center electrode 20 by a predetermined distance. The free end 32 of the ground electrode 30 includes a center-electrode-facing portion 30*h* that faces the center electrode 20. The gap between the center-electrode-facing portion 30*b* and a front end surface 20*a* (see FIGS. 3A and 3B) of the center electrode 20 is a spark gap SG in which a spark discharge occurs.

In the present embodiment, the ground electrode 30 has the two-layer structure including the base material layer 301 and the erosion-resistant layer 302 at least in a region from the center-electrode-facing portion 30*b* to a location that is closer to the fixed end than the front end of the center electrode 20 in cross section extending through the central line of the ground electrode 30 in the width direction. In other words, the ground electrode 30 has the two-layer structure including the base material layer 301 and the erosion-resistant layer 302 at least in a region from the center-electrode-facing portion 30*b* to a second center-electrode-facing portion 30*c* that faces a front-end peripheral portion 20*b* of the center electrode 20 at the fixed-end-31 side. The ground electrode 30 has the two-layer structure in a region that extends to a location that is closer to the fixed end than the front end surface 20*a* of the center electrode 20. For example, the erosion-resistant layer 302 may be arranged so as to extend from the free end 32 to the fixed end 31, that is, over the inner surface 30*a* that faces the center electrode 20 and the insulator 10. The location of the second center-electrode-facing portion 30*c* can be expressed as the location on the inner surface 30*a* of the ground electrode 30 that is shifted from the center-electrode-facing portion 30*b* by a gap length between the ground electrode 30 and the front end surface 20*a* of the center electrode 20, or the location at which a plane that is perpendicular to the line connecting the front end portion of the center electrode 20 and the first center-electrode-facing portion 30*b* and that passes through the front end portion of the center electrode 20 crosses the ground electrode 30.

The erosion-resistant layer 302 is arranged so as to cover 60% to 100% of the base material layer 301 in the width direction, and is preferably line symmetrical about the central line of the base material layer 301 in the width direction. The erosion-resistant layer 302 may be formed such that the width thereof increases or the thickness thereof decreases toward the fixed end.

The terminal electrode 40 is arranged at the rear side of the axial hole 12, and a rear portion of the terminal electrode 40 is exposed at the rear end of the insulator 10. The terminal electrode 40 is connected to a high-voltage cable (not shown) with a plug cap (not shown), and receives a high voltage for spark ignition.

The metal shell 50 is a cylindrical metal member that surrounds and holds a portion of the insulator 10 extending from a portion of the rear-side body portion 18 to the leg portion 13. The metal shell 50 is made of low-carbon steel, and the entire body thereof is plated with, for example, nickel or zinc. The metal shell 50 includes a toot engagement portion 51, a threaded portion 52, a crimping portion 53, and a sealing portion 54. These components are arranged in the order of the crimping portion 53, the tool engagement portion 51, the sealing portion 54, and the threaded portion 52 from the rear side toward the front side. The tool engagement portion 51 engages with a tool used to attach the spark plug 100 to a cylinder head 150 of an internal combustion engine. The threaded portion 52 has a thread and engages with a threaded hole 151 formed in the cylinder head 150.

A projecting portion 60 is formed on the inner surface of the threaded portion 52 so as to project radially inward. The projecting portion 60 is arranged so as to face the diameter-reducing portion 15 and the rear end of the leg portion 13 of the insulator 10. Packing 8, which is an annular sealing member, is disposed between the projecting portion 60 and the diameter-reducing portion 15 of the insulator 10. The packing 8 is in contact with the projecting portion 60 and the diameter-reducing portion 15 and seals the space between the insulator 10 and the metal shell 50. The packing 8 may be formed of, for example, a cold rolled steel plate.

The crimping portion 53 is a thin member provided at the rear end of the metal shell 50 to enable the metal shell 50 to hold the insulator 10. More specifically, when the spark plug 100 is manufactured, the crimping portion 53 is bent inward and pressed toward the front side so that the insulator 10 is retained by the metal shell 50 in such a manner that the front end of the center electrode 20 projects from the front end of the metal shell 50. The sealing portion 54 is flange-shaped and formed at the base of the threaded portion 52. An annular gasket 5 formed by bending a plate is interposed between the sealing portion 54 and an engine head. The spark plug 100 is attached to the cylinder head 150 by attaching the metal shell 50 to the threaded hole 151 in the cylinder head 150.

As described above, the spark plug 100 according to the present embodiment includes the ground electrode 30 including two layers, which are the base material layer 301 and the erosion-resistant layer 302. In the following description, the arrangement pattern, thickness, etc., of the erosion-resistant layer 302 on the base material layer 301 will be studied.

First Study

Figure 2:
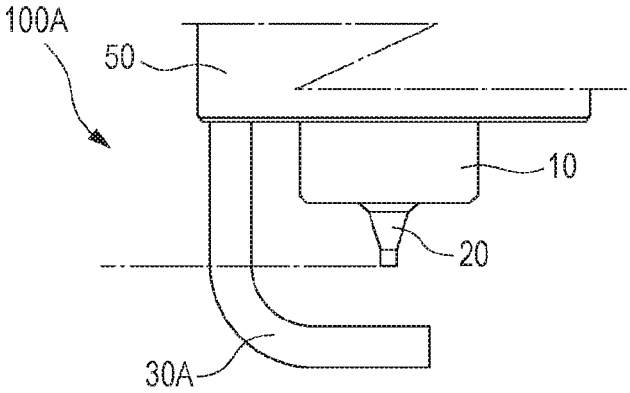
FIG. 2 is an enlarged front view of a front end portion of a spark plug according to the related art.
Figure 3A:
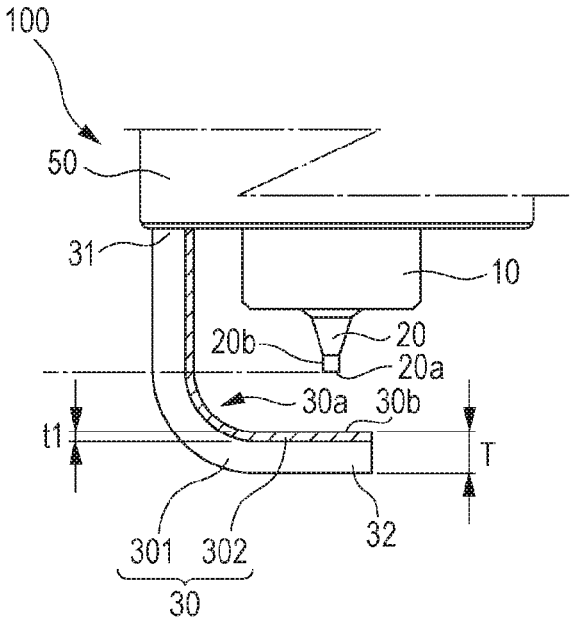
FIGS. 3A and 3B are an enlarged front view and an enlarged right side view, respectively, of a front end portion of the spark plug according to the embodiment.
Figure 3B:
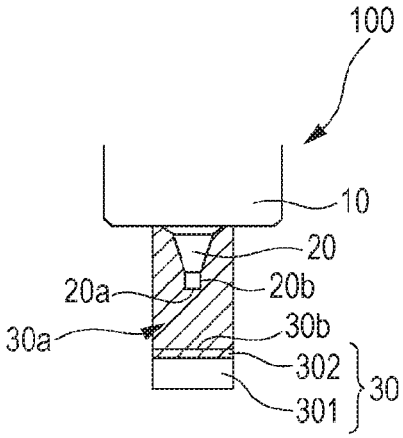

In the first study, materials that may be used as the material of the erosion-resistant layer 302 and the thickness of the erosion-resistant layer 302 formed of each material were studied from the viewpoint of preventing or reducing erosion of the ground electrode 30. FIG. 2 is an enlarged front view of a front end portion of a spark plug according to the related art. FIGS. 3A and 3B are an enlarged front view and an enlarged right side view, respectively, of a front end portion of the spark plug according to the present embodiment.

FIGS. 3A and 3B illustrate the basic structure of the ground electrode 30 used in the first study. As illustrated in FIGS. 3A and 3B, the erosion-resistant layer 302 was provided on the base material layer 301 so as to extend over the entire region of the inner surface 30*a* facing the center electrode 20 and the insulator 10. The overall thickness T of the ground electrode 30 was 1.3 mm, and the thickness t1 of the erosion-resistant layer 302 satisfied 0.2 mm≤t1≤T−0.6 mm. The thermal conductivity λ of the erosion-resistant layer 302 was 40 W/m·K or more. In contrast, in a spark plug 100A according to the related art illustrated in FIG. 2, a ground electrode 30A included only a base material layer, and the thickness of the base material layer was 0.5 mm or more.

In the first study, the base material layer 301 and the erosion-resistant layer 302 of the ground electrode 30 illustrated in FIGS. 3A and 3B were formed by using materials 1 to 5 shown in Table 1, and the amount of erosion of the ground electrode 30 was determined. It is difficult to determine whether the observed erosion is the volumetric erosion of the base material layer 301 or the volumetric erosion of the erosion-resistant layer 302, and it is only necessary to reduce the volumetric erosion of the entire body of the ground electrode 30. Therefore, in this specification, it is concluded that the volumetric erosion of the base material layer 301 was reduced when the volumetric erosion of the entire body of the ground electrode 30 was reduced.

TABLE 1

| | Ni | Cr | Si | Al | Fe | Mn |
|---|---|---|---|---|---|---|
| Material 1 | 60.3% | 23.0% | 0.2% | 1.3% | 15.0% | 0.2% |
| Material 2 | 95.0% | 1.5% | 1.5% | — | — | 2.0% |
| Material 3 | 98.1% | — | 0.7% | 1.0% | — | 0.2% |

TABLE 1-continued

| | Ni | Cr | Si | Al | Fe | Mn |
|---|---|---|---|---|---|---|
| Material 4 | 98.9% | — | 0.4% | 0.5% | — | 0.2% |
| Material 5 | 99.9% | — | — | — | — | — |

Material 1 is a nickel alloy known as Inkonel 601 (trade name) containing 60.3 wt % nickel (Ni), 23.0 wt % chromium (Cr), 0.2 wt % silicon (Si), 1.3 wt % aluminum (Al), 15.0 wt % iron (Fe), and 0.2% manganese (Mn).

Material 2 is a nickel alloy containing 95.0 wt % Ni, 1.5 wt % Cr, 1.5 wt % Si, and 2.0% Mn.

Material 3 is a nickel alloy containing 98.1 wt % Ni, 0.7 wt % Si, 1.0 wt % Al, and 0.2% Mn.

Material 4 is a nickel alloy containing 98.9 wt % Ni, 0.4 wt % Si, 0.5 wt % Al, and 0.2% Mn.

Material 5 is pure nickel containing 99.9 wt % Ni.

The tensile strength (Mpa) and thermal conductivity λ (W/m·K) of each material are shown in Table 2. As the nickel content increases, the thermal conductivity λ increases and the tensile strength decreases. This shows that the tensile strength can be increased by forming a nickel alloy in which nickel is mixed with other materials that serve as sub-materials.

TABLE 2

| | Material 1 | Material 2 | Material 3 | Material 4 | Material 5 |
|---|---|---|---|---|---|
| Tensile Strength (Mpa) | 600 | 520 | 480 | 400 | 320 |
| Thermal Conductivity (W/m · K) | 12 | 30 | 40 | 60 | 90 |

In the following study, M12HEX14 spark plugs (diameter of the threaded portion is 12 mm and the size of the hexagonal portion is 14 mm) including a 0.6-mm-diameter iridium (Ir) center electrode and having a spark gap SG of 1.1 mm were used. Each spark plug included the two-layer ground electrode 30 obtained by bonding the erosion-resistant layer 302 having a thickness of t1=0.1 mm, 0.2 mm, 0.4 mm, 0.6 mm, 0.8 mm, or 1.0 mm to the base material layer 301 by resistance welding. The ground electrode 30 was formed such that the overall thickness T thereof was 1.3 mm and the width thereof was 2 mm. A 100-hour endurance test was performed at wide-open throttle (WOT) and 6000 rpm by using a 1,500 cc naturally aspirated port-injection engine, and then the volumetric erosion was determined. The volume of the ground electrode 30 was calculated from external dimensions determined by subjecting the entire body of the ground electrode 30 to X-ray CT scanning, and the volumetric erosion was determined by subjecting the remaining volume from the initial volume.

Experiment 1: In Experiment 1, the base material layer 301 was made of material 1 and the erosion-resistant layer 302 was made of materials 2 to 5. As a comparative example, the amount of erosion caused when a ground electrode including only the base material layer 301 was used was determined to be 2.8 $mm^3$. Table 3 shows the result of Experiment 1. In Table 3, "BR" indicates that breakage of the ground electrode 30 occurred.

TABLE 3

| | Base Material Erosion-Resistant Material | Material 1 Thickness 1.3 mm | | | |
|---|---|---|---|---|---|
| | | Material 2 | Material 3 | Material 4 | Material 5 |
| | | Amount of Erosion ($mm^3$) | | | |
| Thickness t1 of Erosion-Resistant Layer (mm) | 0.1 | 2.7 | 2.5 | 2.3 | 2.2 |
| | 0.2 | 2.7 | 1.8 | 1.6 | 1.5 |
| | 0.4 | 2.7 | 1.7 | 1.5 | 1.4 |
| | 0.6 | 2.7 | 1.7 | 1.5 | 1.4 |
| | 0.8 | 2.7 | BR | BR | BR |
| | 1.0 | 2.7 | BR | BR | BR |

When the erosion-resistant layer 302 was made of material 2, the amount of erosion of the entire body of the ground electrode 30 was 2.7 $mm^3$ irrespective of the thickness t1. When the erosion-resistant layer 302 was made of material 3, the amount of erosion of the entire body of the ground electrode 30 was 1.8 $mm^3$ or less for the thickness t1 of 0.2 mm or more and 0.6 mm or less. When the thickness of the erosion-resistant layer 302 was 0.8 mm or more, that is, when the thickness of the base material layer 301 was 0.5 mm or less, breakage of the ground electrode 30 occurred. When the erosion-resistant layer 302 was made of material 4, the amount of erosion of the entire body of the ground electrode 30 was 1.6 $mm^3$ or less for the thickness t1 of 0.2 mm or more and 0.6 mm or less. When the thickness of the erosion-resistant layer 302 was 0.8 mm or more, that is, when the thickness of the base material layer 301 was 0.5 mm or less, breakage of the ground electrode 30 occurred. When the erosion-resistant layer 302 was made of material 5, the amount of erosion of the entire body of the ground electrode 30 was 1.5 $mm^3$ or less for the thickness t1 of 0.2 mm or more and 0.6 mm or less. When the thickness of the erosion-resistant layer 302 was 0.8 mm or more, that is, when the thickness of the base material layer 301 was 0.5 mm or less, breakage of the ground electrode 30 occurred.

Experiment 2: In Experiment 2, the base material layer 301 was made of material 2 and the erosion-resistant layer 302 was made of materials 3 to 5. As a comparative example, the amount of erosion caused when a ground electrode including only the base material layer 301 was used was determined to be 2.7 $mm^3$. Table 4 shows the result of Experiment 2. In Table 4, "BR" indicates that breakage of the ground electrode 30 occurred.

TABLE 4

| | Base Material Erosion-Resistant Material | Material 2 Thickness 1.3 mm | | |
|---|---|---|---|---|
| | | Material 3 | Material 4 | Material 5 |
| | | Amount of Erosion ($mm^3$) | | |
| Thickness t1 of Erosion-Resistant Layer (mm) | 0.1 | 2.4 | 2.3 | 2.2 |
| | 0.2 | 1.8 | 1.5 | 1.5 |
| | 0.4 | 1.7 | 1.5 | 1.4 |
| | 0.6 | 1.6 | 1.5 | 1.4 |
| | 0.8 | BR | BR | BR |
| | 1.0 | BR | BR | BR |

When the erosion-resistant layer 302 was made of material 3, the amount of erosion of the entire body of the ground electrode 30 was 1.8 $mm^3$ or less for the thickness t1 of 0.2 mm or more and 0.6 mm or less. When the thickness of the erosion-resistant layer 302 was 0.8 mm or more, that is, when the thickness of the base material layer 301 was 0.5 mm or less, breakage of the ground electrode 30 occurred. When the erosion-resistant layer 302 was made of material 4, the amount of erosion of the entire body of the ground electrode 30 was 1.5 $mm^3$ or less for the thickness t1 of 0.2 mm or more and 0.6 mm or less. When the thickness of the erosion-resistant layer 302 was 0.8 mm or more, that is, when the thickness of the base material layer 301 was 0.5 mm or less, breakage of the ground electrode 30 occurred. When the erosion-resistant layer 302 was made of material 5, the amount of erosion of the entire body of the ground electrode 30 was 1.5 $mm^3$ or less for the thickness t1 of 0.2 mm or more and 0.6 mm or less. When the thickness of the erosion-resistant layer 302 was 0.8 mm or more, that is, when the thickness of the base material layer 301 was 0.5 mm or less, breakage of the ground electrode 30 occurred.

The results of Experiments 1 and 2 show that when a material having a thermal conductivity λ that satisfies λ≥40 (W/m·K), more specifically, any one of materials 3 to 5, is used as the material of the erosion-resistant layer 302, and when the thickness t1 of the erosion-resistant layer 302 is 0.2 mm or more, the amount of erosion of the ground electrode can be effectively reduced, and that as the thickness t1 of the erosion-resistant layer 302 increases, the erosion resistance increases. Since the overall thickness T of the ground electrode 30 is set to 1.3 mm, when the thickness t1 of the erosion-resistant layer 302 is increased such that the thickness (T−t1) of the base material layer 301 is reduced to 0.5 mm or less, breakage of the ground electrode 30 occurs. Therefore, the thickness t1 of the erosion-resistant layer 302 is preferably less than 0.8 mm, and more preferably, 0.7 mm or less so that the thickness of the base material layer 301 (T−t1) is 0.6 mm or more. This can be expressed as 0.2 mm≤t1<T−0.5 mm, and more preferably, 0.2 mm≤t1≤T−0.6 mm.

When the thermal conductivity λ is 40 (W/m·K) or more, the heat is efficiently dissipated from the erosion-resistant layer 302 and a temperature increase is suppressed in a region where the ground electrode 30 forms a spark together with the center electrode 20, for example, a region from the center-electrode-facing portion 30*b* to the second center-electrode-facing portion 30*c*. Accordingly, the volumetric erosion of the ground electrode 30 due to the temperature increase can be suppressed. The volumetric erosion of the ground electrode 30 occurs when the atoms in the ground electrode 30 are energized in response to the temperature increase in the material of the ground electrode 30 and knocked out of the ground electrode 30 as a result of nitrogen ions in the combustion chamber hitting the outer surface of the ground electrode 30. Since the temperature greatly affects the volumetric erosion of the ground electrode 30, the erosion of the base material layer 301 due to the temperature increase can be reduced by reducing the temperature increase of the base material layer 301 by arranging the erosion-resistant layer 302, which has a high heat dissipation performance, on the base material layer 301. It is not necessary that the erosion-resistant layer 302 cover the entire region of the ground electrode 30 in the width direction as long as the erosion-resistant layer 302 is formed line symmetrically about the central line of the ground electrode 30 in the width direction, where a spark is likely to be formed, and covers 60% of the ground electrode 30 in the width direction. The erosion-resistant layer 302 may, of course, also be formed so as to cover the entire region (100%) of the ground electrode 30 in the width direction.

Experiment 3 was performed by using material 3 as the material of the base material layer 301. As a comparative example, a ground electrode 30 including only the base material layer 301 was tested. As a result, physical breakage of the ground electrode 30 occurred due to vibration. This is probably because the tensile strength of material 3 was 480 (Mpa), as shown in Table 2, and durability against a vibration of 30 G and a temperature of 800° C. was not sufficient. Therefore, experiments with the base material layer 301 made of materials 3 to 5 and the erosion-resistant layer 302 made of materials 4 and 5 could not be performed.

Figure 4:
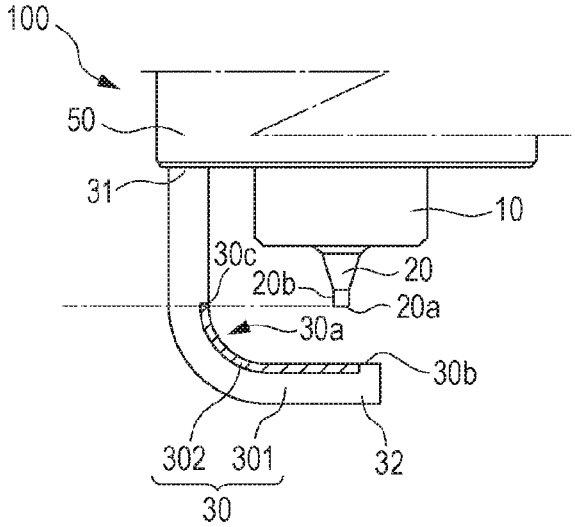
FIG. 4 is an enlarged front view of a front end portion of another spark plug according to the embodiment.

In the first study, the ground electrode 30 in which the erosion-resistant layer 302 was formed over the entire region of the inner surface 30*a* was used. Alternatively, a ground electrode 30 illustrated in FIG. 4 may instead be used. This ground electrode 30 has a two-layer structure including, in addition to the base material layer 301, the erosion-resistant layer 302 that extends at least in a region from the center-electrode-facing portion 30*b* to the second center-electrode-facing portion 30*c* that faces the front-end peripheral portion 20*b* of the center electrode 20 at the fixed-end-31 side. FIG. 4 is an enlarged front view of a front end portion of another spark plug according to the present embodiment.

Second Study

Figure 5:
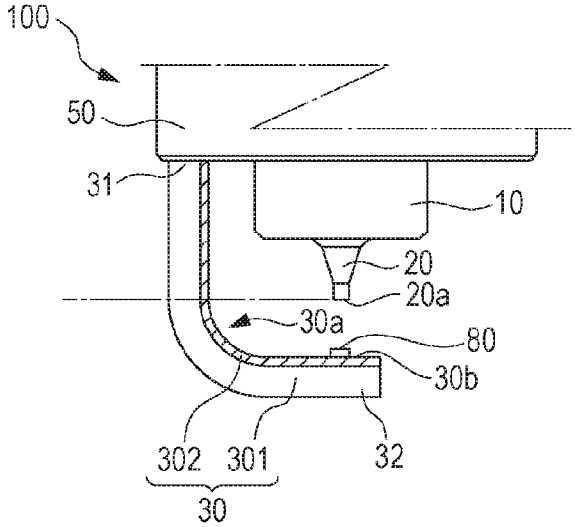
FIG. 5 is an enlarged front view of a front end portion of a spark plug according to the embodiment which includes a noble metal chip and which is used in a second study.

In the first study, materials used as the material of the erosion-resistant layer 302 and the thickness of the erosion-resistant layer 302 for each material were studied from the viewpoint of preventing or reducing erosion of the ground electrode 30. In a second study, the effect of reducing the volumetric erosion of the ground electrode 30 obtained when a noble metal chip 80 is provided on the center-electrode-facing portion 30*b* of the ground electrode 30 was studied. FIG. 5 is an enlarged front view of a front end portion of a spark plug according to the present embodiment which includes the noble metal chip 80 and which is used in the second study. The noble metal chip 80 can be regarded as a projection that projects from the erosion-resistant layer 302 of the ground electrode 30.

The noble metal chip 80 was bonded to the erosion-resistant layer 302 by resistance welding. The structures of other portions were the same as those of the spark plug 100 described above with reference to FIGS. 3A and 3B. More specifically, the base material layer 301 was made of material 1, the erosion-resistant layer 302 was made of material 3, and the thickness t1 of the erosion-resistant layer 302 was t1=0.4 mm. The overall thickness T of the ground electrode 30 was 1.3 mm, and the width of the ground electrode 30 was 2 mm. The noble metal chip 80 had a diameter of 0.8 mm and a thickness of 0.2 mm, and was made of pure platinum (Pt). The study method for the second study was the same as that for the first study.

Table 5 shows the result of the second study.

TABLE 5

| | Volumetric Erosion ($mm^3$) |
|---|---|
| Ground Electrode without Pt Chip | 1.7 |
| Ground Electrode with Pt Chip | 1.2 |

The volumetric erosion caused when the noble metal chip 80 was provided was 1.2 $mm^3$, and was reduced by 30% from 1.7 $mm^3$, which was the volumetric erosion caused when the noble metal chip 80 was not provided. In the spark plug 100 according to the present embodiment, the erosion-resistant layer 302 is provided to reduce the volumetric erosion of the ground electrode 30. It was confirmed that, when the noble metal chip 80 is additionally provided on the center-electrode-facing portion 30*b*, at which breakdown is most likely to occur, the volumetric erosion of the ground electrode 30 can be further reduced. The noble metal chip 80 may be made of iridium (Ir), rhodium (Rh), or ruthenium (Ru) instead of platinum (Pt). The noble metal chip 80 may be provided on the ground electrode 30 including the erosion-resistant layer 30 that extends only from the center-electrode-facing portion 30*b* to the second center-electrode-facing portion 30*c*, as illustrated in FIG. 4, instead of the ground electrode 30 including the erosion-resistant layer 302 that extends over the entire region of the inner surface 30*a*. The noble metal chip 80 may be made of a noble metal alloy.

Third Study

In the third study, the bonding method and bonding strength of the noble metal chip 80 on the ground electrode 30 were studied. More specifically, the bonding strength obtained when the noble metal chip 80 was bonded to the erosion-resistant layer 302 (bonding method 1) and that obtained when the noble metal chip 80 was directly bonded to the base material layer 301 (bonding method 2) were observed. The materials of the base material layer 301 and the erosion-resistant layer 302, the thickness t1 of the erosion-resistant layer 302, the overall thickness T and width of the ground electrode 30, and the diameter, thickness, and material of the noble metal chip 80 were the same as those in the second study.

Figure 6:
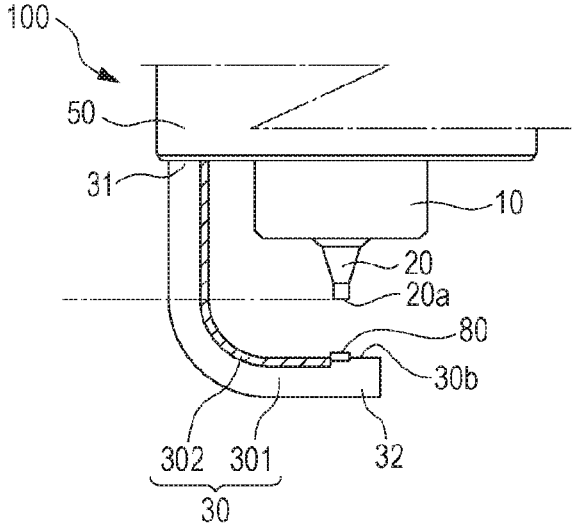
FIG. 6 is an enlarged front view of a front end portion of a spark plug according to the embodiment in which a noble metal chip is directly bonded to a base material layer and which is used in a third study.

Spark plugs 100 used in the third study included the spark plug used in the second study, in which the noble metal chip 80 was bonded to the erosion-resistant layer 302, and a spark plug illustrated in FIG. 6 in which the erosion-resistant layer 302 is not provided on the center-electrode-facing portion 30*b* and in which the noble metal chip 80 is directly bonded to the base material layer 301. FIG. 6 is an enlarged front view of a front end portion of a spark plug according to the present embodiment in which the noble metal chip 80 is directly bonded to the base material layer 301 and which is used in the third study.

In the third study, the ground electrode 30 was subjected to a bench test in which a process of heating the ground electrode 30 with a gas burner for one minute and then air-cooling the ground electrode 30 (burner is turned off) for 30 seconds was repeated for 1000 cycles. After the test, the bonding surface was observed with a magnifying glass and evaluated. The ground electrode 30 was heated with the gas burner such that the temperature at the front end thereof was increased to about 1000° C. by using a radiation thermometer. In the observation using the magnifying glass, portions in which the noble metal chip 80 was separated from the erosion-resistant layer 302 or the base material layer 301 by 0.1 mm or more were regarded as separated portions.

The result of the third study showed that separation of the noble metal chip 80 occurred when the bonding method 1, in which the noble metal chip 80 was bonded to the erosion-resistant layer 302, was used but did not occur when the bonding method 2, in which the noble metal chip 80 was directly bonded to the base material layer 301, was used. This is probably because since material 3, which was the material of the erosion-resistant layer 302, had a thermal conductivity λ higher than that of material 1, the heat was dissipated through the erosion-resistant layer 302 during resistance welding and the temperature of the bonding surface between the noble metal chip 80 and the erosion-resistant layer 302 did not increase to the desired temperature, resulting in a reduction in weldability. Thus, it was confirmed that, when the noble metal chip 80 is used, the noble metal chip 80 is preferably bonded directly to the base material layer 301 instead of the erosion-resistant layer 302.

Figure 7:
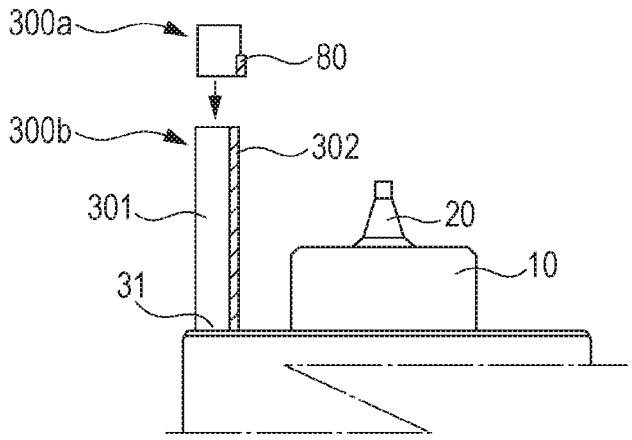
FIG. 7 illustrates an example of a method for manufacturing a ground electrode in which a noble metal chip is directly bonded to a base material layer.

An example of a method for directly bonding the noble metal chip 80 to the base material layer 301 will be described with reference to FIG. 7. FIG. 7 illustrates an example of a method for manufacturing the ground electrode in which the noble metal chip 80 is directly bonded to the base material layer 301. First, the noble metal chip 80 is bonded, by resistance welding, to a chip-bonding piece 300*a*, which is made of material 1 and serves as a portion of the base material layer 301 after the bonding process. Thus, the noble metal chip 80 that is directly bonded to a portion of the base material layer 301 is prepared. Then, a main ground-electrode piece 300*b*, on which the erosion-resistant layer 302 is bonded, is bonded to the front end surface 57 of the metal shell 50 by resistance welding. Lastly, the chip-bonding piece 300*a*, on which the noble metal chip 80 is bonded, is bonded to the main ground-electrode piece 300*b* by resistance welding, so that the ground electrode 30 in which the noble metal chip 80 is directly bonded to the base material layer 301 is obtained. The chip-bonding piece 30*a* may have a two-piece structure including a front-end piece and a bonding piece (the entire body has a three-piece structure). In such a case, the erosion-resistant layer 302 may be bonded to the front-end piece so that a ground electrode 30 in which the erosion-resistant layer 302 extends over the entire region of the Miler surface except for the region where the noble metal chip 80 is bonded can be obtained.

Fourth Study

When the metal shell 50 and the ground electrode 30 are bonded together, resistance welding is performed at a high pressure and a high current so that diffusion bonding, which involves mutual diffusion of the bonded materials, occurs in the bonding region. Since the ground electrode 30 according to the present embodiment includes the erosion-resistant layer 302 having a high thermal conductivity λ, heat is easily dissipated to the metal shell 50 through the erosion-resistant layer 302. Accordingly, uneven welding easily occurs in the bonding region, resulting in non-uniform strength distribution. The erosion-resistant layer 302 having a high thermal conductivity λ also has a high electrical conductivity, and allows the current applied thereto to flow into the metal shell 50. This makes it difficult to increase the temperature in the bonding region to the desired temperature. Therefore, to appropriately bond the ground electrode 30 and the metal shell 50 together, the size of the erosion-resistant layer 302 at the fixed-end-31 side of the ground electrode 30 is preferably reduced.

Accordingly, in the fourth study, the weldability between the metal shell 50 (front end surface 57) and the ground electrode 30 was studied. More specifically, the thickness t2 of the erosion-resistant layer 302 at the fixed end 31 of the ground electrode 30 bonded to the front end surface 57 of the metal shell 50 was changed, and the weldability for each thickness was observed.

Figure 8:
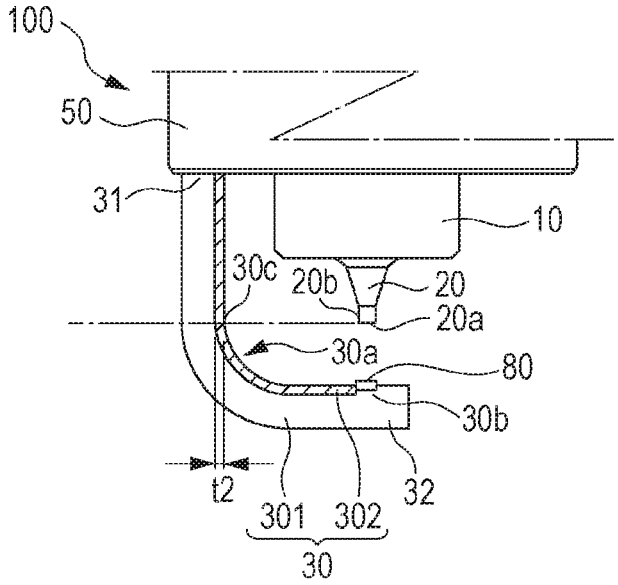
FIG. 8 is an enlarged front view of a front end portion of a spark plug according to the embodiment used in a fourth study.

FIG. 8 is an enlarged front view of a front end portion of a spark plug according to the present embodiment used in the fourth study. Referring to FIG. 8, in the fourth study, the thickness t1 of the erosion-resistant layer 302 in the region from the second center-electrode-facing portion 30*c* to the first center-electrode-facing portion 30*b* was set to 0.4 mm, and the thickness t2 of the erosion-resistant layer 302 in the region from the second center-electrode-facing portion 30*c* to the fixed end 31 of the ground electrode 30 was set to 0 mm, 0.1 mm, 0.2 mm, 0.3 mm, and 0.4 mm. The volumetric erosion of the ground electrode 30 caused under these conditions was observed. The structures of other portions of the spark plug 100 were the same as those of the spark plug 100 illustrated in FIG. 6 used in the third study. The method for determining the amount of erosion of the ground electrode 30 in the fourth study was the same as that in the first study. In the fourth study in which the weldability was observed, a process of heating the welding region (bonding region) between the front end surface 57 of the metal shell 50 and the ground electrode 30 with a gas burner for one minute and then air-cooling the welding region for 30 seconds was repeated for 1000 cycles, and then an impact test according to JIS B 8031 7.4 was performed. The welding region between the front end surface 57 of the metal shell 50 and the ground electrode 30 was heated with the gas burner such that the temperature in the welding region was increased to about 200° C. by using a radiation thermometer.

Table 6 shows the result of the fourth study. In Table 6, the letter G indicates that no abnormality was found after twice the time according to JIS, and the letter F indicates that no abnormality was found during the impact test according to JIS but an abnormality was found within twice the time according to JIS. In the impact test according to JIS, an impact was applied 400 times per minute for 10 minutes. Examples of abnormalities included the occurrence of cracks or the like in the welding region between the ground electrode 30 and the front end surface 57 of the metal shell 50 and separation of the ground electrode 30 from the front end surface 57 of the metal shell 50. These abnormalities were observed by using a microscope.

TABLE 6

| t2 (mm) | Volumetric Erosion ($mm^3$) | Weldability to Metal Shell |
|---|---|---|
| 0 | 1.5 | G |
| 0.1 | 1.5 | G |
| 0.2 | 1.5 | G |
| 0.3 | 1.5 | F |
| 0.4 | 1.5 | F |

As is clear from Table 6, when the thickness t2 of the erosion-resistant layer 302 was less than 0.3 mm, more preferably, 0.2 mm or less, the weldability between the ground electrode 30 and the front end surface 57 of the metal shell 50 was satisfactory. When the thickness t2 of the erosion-resistant layer 302 was 0.3 mm or more, although no abnormality was found in the impact test according to JIS, an abnormality was found in the impact test according to the fourth study. The volumetric erosion of the ground electrode 30 was 1.5 $mm^3$ irrespective of the thickness t2 of the erosion-resistant layer 302.

The result of the fourth study shows that the ground electrode 30 including the erosion-resistant layer 302 can be reliably welded to the metal shell 50 when the thickness t2 of the erosion-resistant layer 302 at the fixed-end-31 side of the ground electrode 30 is less than 0.3 mm, more preferably, 0.2 mm or less.

The erosion-resistant layer 302 may be formed so as to have the thickness t2 only in a region near the fixed end 31 of the ground electrode 30 instead of the region from the second center-electrode-facing portion 30*c* to the fixed end 31. Alternatively, a region free from the erosion-resistant layer 302 may be provided at the fixed-end-31 side of the ground electrode 30 so that a gap is provided between the front end surface 57 of the metal shell 50 and the erosion-resistant layer 302. In this case, only the base material layer 301 of the ground electrode 30 is in contact with the front end surface 57 of the metal shell 50, so that the current and heat are prevented from being dissipated through the erosion-resistant layer 302, and it is possible to prevent or suppress a reduction in the bonding strength between the ground electrode 30 and the metal shell 50.

As described above, according to the spark plug 100 of the present embodiment, the volumetric erosion of the ground electrode 30 can be reduced without using a noble metal. More specifically, the volumetric erosion of the ground electrode 30 can be reduced by bonding the erosion-resistant layer 302 on the base material layer 301 of the ground electrode 30, the erosion-resistant layer 302 being made of the same type of material as the material of the base material layer 301 and having a thermal conductivity $\lambda$ of 40 W/m·K or more. The volumetric erosion of the ground electrode 30 can be reduced as long as the erosion-resistant layer 302 extends at least from the center-electrode-facing portion 30*b* to a location closer to the fixed end 31 than the front-end peripheral portion 20*b* of the center electrode 20 is in cross section extending through the central line of the ground electrode 30 in the width direction. To reduce the volumetric erosion of the ground electrode 30 while ensuring sufficient strength of the ground electrode 30, the thickness t1 of the erosion-resistant layer 302 preferably satisfies $0.2\ mm \le t1 < T-0.5\ mm$, more preferably, $0.2\ mm \le t1 \le T-0.6\ mm$.

The volumetric erosion of the ground electrode 30 can be further reduced by arranging the noble metal chip 80 on the center-electrode-facing portion 30*b* of the ground electrode 30. When the noble metal chip 80 is directly bonded to the base material layer 301, sufficient bonding strength can be provided between the noble metal chip 80 and the ground electrode 30. When the thickness t2 of the erosion-resistant layer 302 at the fixed-end-31 side of the ground electrode 30 is less than 0.3 mm, more preferably, 0.2 mm or less, sufficient bonding strength can be maintained between the ground electrode 30 and the metal shell 50.

Modifications (1) In the above-described embodiment, the ground electrode 30 includes the erosion-resistant layer 302 that extends over the entire region of the inner surface 30*a*, as illustrated in FIGS. 3A and 3B, or the erosion-resistant layer 302 that extends only from the center-electrode-facing portion 30*b* to the second center-electrode-facing portion 30*c*, as illustrated in FIG. 4. However, the arrangement of the erosion-resistant layer 302 is not limited as long as the erosion-resistant layer 302 is provided on the inner surface 30*a* of the ground electrode 30 in a region from any location between the free end 32 and the center-electrode-facing portion 30*b* to any location between the fixed end 31 and the second center-electrode-facing portion 30*c*.

(2) In the above-described embodiment, the structure of the spark plug 100 is described. The spark plug 100 according to the above-described embodiment may be used in combination with a long spark coil which outputs a secondary current of 50 mA or more for 2 msec or more during discharge. In such a case, the advantage of the spark plug 100 according to the present embodiment, in which the amount of erosion of the ground electrode is reduced, over the spark plug according to the related art is more significant. More specifically, when the time for which electricity is applied to the spark plug is long, the discharge position on the ground electrode is likely to be shifted from the breakdown position. In the spark plug according to the related art, erosion of the ground electrode due to the movement of the discharge position cannot be reduced. In contrast, in the spark plug 100 according to the present embodiment, since the erosion-resistant layer 302 is provided on the base material layer 301 of the ground electrode 30, the erosion of the ground electrode 30 due to the movement of the discharge position can be prevented or reduced. Thus, the spark plug 100 is suitable for use in combination with a long spark coil.

Although the present invention has been described based on examples and modifications, the above-described embodiment of the invention is intended to facilitate understanding of the present invention, and does not limit the present invention. Modifications and improvements are possible without departing from the spirit and scope of the claims of the present invention, and equivalents thereof are included in the present invention. For example, the technical features of the embodiments and modifications corresponding to the technical features according to the aspects described in the Summary of the Invention section may be replaced or combined as appropriate to solve some or all of the above-described problems or obtain some or all of the above-described effects. The technical features may also be omitted as appropriate unless they are described as being essential in this specification.

Having described the invention, the following is claimed:

1. An ignition plug comprising:

an insulator having an axial hole;

a metal shell that covers an outer periphery of the insulator;

a center electrode disposed in the axial hole of the insulator and having a front end exposed at a front end of the insulator; and a ground electrode having a fixed end fixed to the metal shell, a free end including a center-electrode-facing portion that faces a front end surface of the center electrode, and an inner surface that faces the center electrode and the insulator, wherein the ground electrode includes a first layer and a second layer having a composition different from a composition of the first layer and stacked on an inner surface of the first layer, the second layer having a thermal conductivity of 40 w/m·K or more and extending at least from the center-electrode-facing portion to a location closer to the fixed end than the front end of the center electrode in cross section extending through a central line of the ground electrode in a width direction, and wherein, when a thickness of the ground electrode is T (mm) and a thickness of the second layer is t1 (mm), 0.2 mm≤t1≤T−0.6 mm is satisfied.

2. The ignition plug according to claim 1, wherein the center-electrode-facing portion has a projection that projects beyond the second layer.

3. The ignition plug according to claim 2, wherein the projection is bonded to the first layer.

4. The ignition plug according to claim 2, wherein the projection contains a noble metal as a main component.

5. The ignition plug according to any one of claims 1 to 4, wherein the second layer is arranged so as to extend over an entire region of the inner surface of the ground electrode, and wherein the thickness t1 of the second layer is 0.2 mm or less in a region from a second center-electrode-facing portion that faces a front-end peripheral portion of the center electrode at a fixed-end side to the fixed end.

6. The ignition plug according to any one of claims 1 to 4, wherein the second layer is made of a nickel (Ni) alloy or an iron (Fe) alloy that differs from a material of the first layer.

7. The ignition plug according to claim 5, wherein the second layer is made of a nickel (Ni) alloy or an iron (Fe) alloy that differs from a material of the first layer.

* * * * *